United States Patent [19]

Matsuda

[11] 4,338,800

[45] Jul. 13, 1982

[54] VELVET-TYPE FASTENER WEB

[75] Inventor: Yoshio Matsuda, Nyuzen, Japan

[73] Assignee: Yoshida Kogyo K.K., Tokyo, Japan

[21] Appl. No.: 147,760

[22] Filed: May 8, 1980

[30] Foreign Application Priority Data

May 9, 1979 [JP] Japan ..... 54-56789

[51] Int. Cl.[3] ..... D04B 7/12; D04B 9/12; D04B 11/08; D04B 23/08

[52] U.S. Cl. ..... 66/194; 66/195; 66/196; 66/87; 28/161

[58] Field of Search ..... 428/85, 253, 100; 28/161; 66/194, 84, 87, 192, 193, 196, 195

[56] References Cited

U.S. PATENT DOCUMENTS

| | | | |
|---|---|---|---|
| 3,320,649 | 5/1967 | Naimer | 28/161 |
| 3,530,687 | 9/1970 | Hamano | 28/161 X |
| 3,539,436 | 11/1970 | Hamano | 28/161 X |
| 3,718,725 | 2/1973 | Hamano | 28/161 X |
| 3,727,433 | 4/1973 | Hamano | 66/84 |
| 3,845,641 | 11/1974 | Waller | 66/192 |

*Primary Examiner*—Ronald Feldbaum

*Attorney, Agent, or Firm*—Hill, Van Santen, Steadman, Chiara & Simpson

[57] ABSTRACT

A velvet-type or snap-together fastener web comprises a warp-knitted ground structure and series of interlooped loops disposed in at least every other wale, each loop including a pair of mushroomed stems projecting from the wale at each course. To produce such a fastener web, a double-faced fabric is knitted on a Raschel warp knitting machine, and is separated into a plurality of strips by dissolving transversely spaced water-soluble threads in the fabric. Each strip is divided into front and back fabric webs by severing thermoplastic thread portions therebetween, leaving a multiplicity of raised stems on each fabric web. The raised fabric stems are then heated to mushroom their ends.

7 Claims, 16 Drawing Figures

FIG. 1
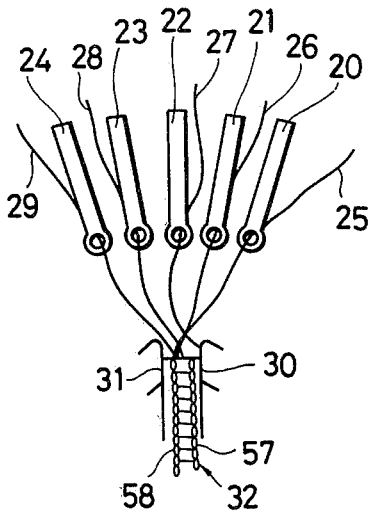
FIG. 2
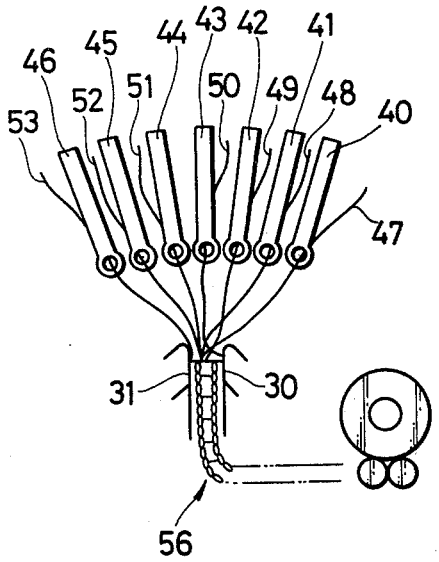
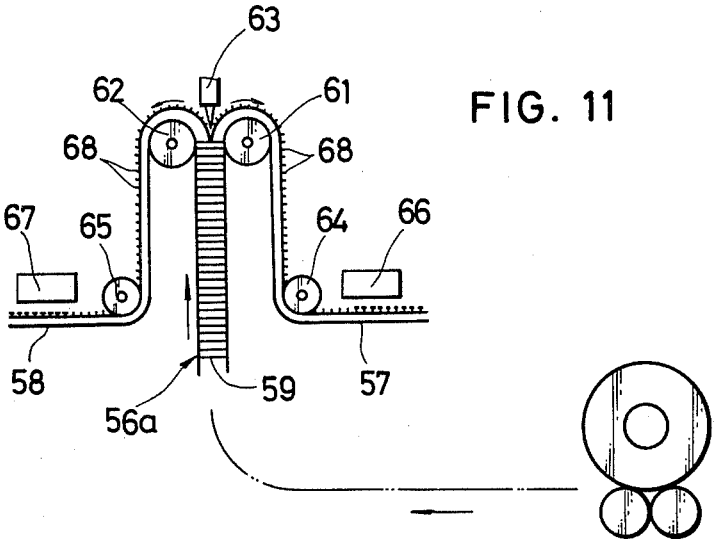
FIG. 11

VELVET-TYPE FASTENER WEB

BACKGROUND OF THE INVENTION

1. Field of the Invention

The present invention relates to a velvet-type or snap-together fastener web including a multiplicity of locking stems.

2. Prior Art

The term "velvet-type" as used herein refers to a synthetic material made with both a surface of tiny hooks and a complimentary surface of an adhesive pile, used, as in garments, in matching strips that can be pressed together or pulled apart for easy fastening and unfastening.

There have heretofore been known a variety of velvet-type fastener fabrics including locking stems as in the form of mushrooms, hooks or the like for coupling engagement with loops on companion fastener webs. Almost all of the known velvet-type fastener fabrics are of a woven structure with plastic pile threads being cut to form the locking stems. U.S. Pat. No. 2,717,437 patented Sept. 13, 1955 shows one form of such velvet-type fabric. The woven fastener fabrics, however, are relatively rigid and the locking stems tend to be loosened out when pulled by the loops on the other fastener fabric as it is peeled off. The woven velvet-type fastener fabrics cannot be mass-produced simultaneously on a single loom, and hence are relatively expensive.

Japanese Laid-Open Patent Publication No. 47-28255 published Oct. 31, 1972 discloses a warp-knit pile fabric including hooks, which are retained in place by hardened resin impregnated in the knit ground structure. Thus, the knitting of such a pile fabric must be followed by additional steps of dipping the knit ground structure in a resinous solution and thermally setting the resin to positionally fix the hooks.

SUMMARY OF THE INVENTION

According to the present invention, a series of loops of thermoplastic monofilament are knitted with the stitches in each of selected wales of a knitted ground structure. Each of the loops includes a pair of stems projecting from the knitted ground structure at one of the courses thereof and having a pair of locking ends, respectively.

A velvet-type fastener web is manufactured by knitting a double-faced fabric including a pair of front and back ground structures and a plurality of thermoplastic monofilaments knitted with and having portions extending between the front and back ground structures. Said portions are then severed to separate the front and back structures each having a plurality of raised thermoplastic stems, and the raised stems are heated to form locking ends thereon. Each of the front and back ground structures can include a plurality of transversely spaced soluble threads, which are dissolved to divide the ground structure into a plurality of strips.

It is an object of the present invention to provide a knitted velvet-type fastener web having a multiplicity of locking stems retained firmly in the ground structure instead of being pulled off in repeated use.

Another object of the present invention is to provide a knitted velvet-type fastener web which is durable in structure, reliable in operation and less costly in manufacture.

Still another object of the present invention is to provide such a fastener web which is sufficiently flexible for being applied to pliable materials.

Many other advantages, features and additional objects of the present invention will become manifest to those versed in the art upon making references to the detailed description and the accompanying drawings in which preferred embodiments incorporating the principles of the present invention are shown by way of illustrative example.

BRIEF DESCRIPTION OF THE DRAWINGS

FIG. 1 is a schematic side elevational view of a portion of a Raschel warp knitting machine including guides and needles for carrying out a method of the present invention;

FIG. 2 is a schematic side elevational view of a portion of another Raschel warp knitting machine;

FIG. 11, appearing with FIG. 1, is a schematic elevational view illustrative of the separation and heat treatment of the double-faced fabric shown in FIG. 10;

DETAILED DESCRIPTION

Figure 3:
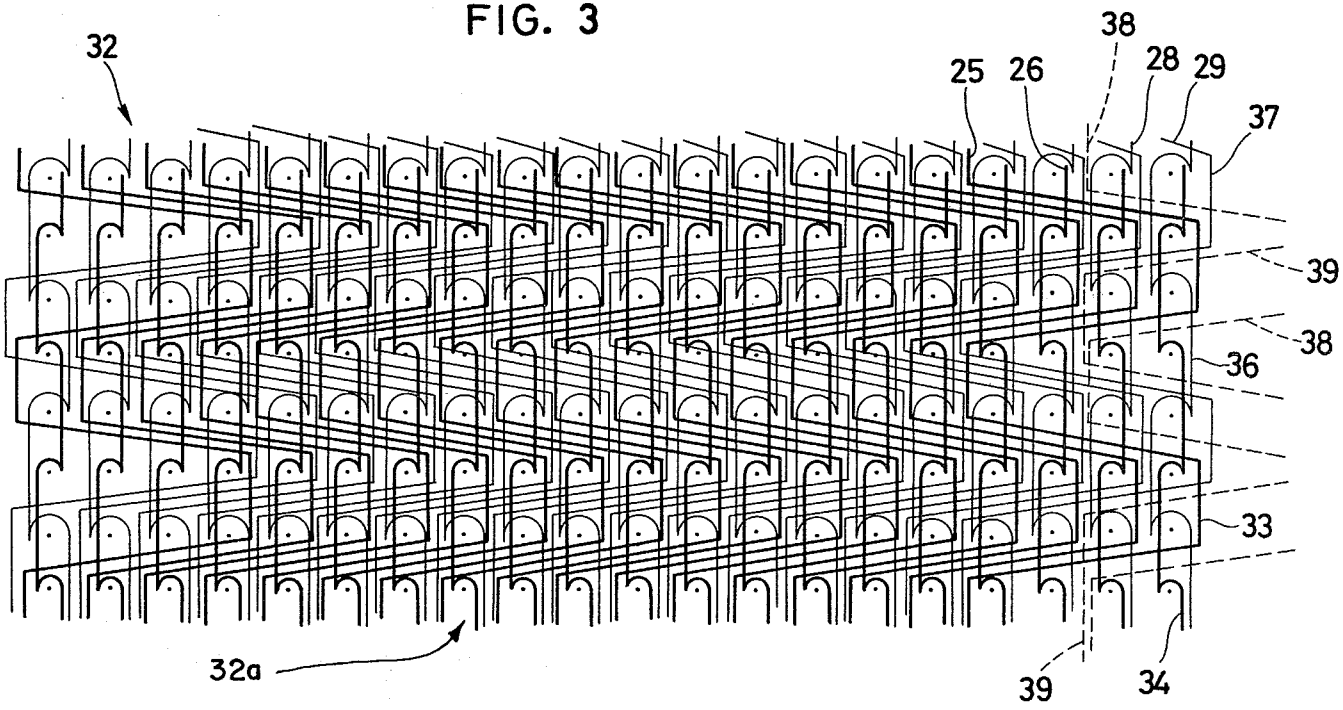
FIG. 3 is a point diagram showing lapping movements for a double-faced fabric according to a method of the present invention.

A warp-knitted velvet-type fastener web according to the present invention is manufactured on a Raschel warp knitting machine having a total of five guide bars supporting guides 20,21,22,23 and 24 (FIG. 1) carrying respective threads 25,26,27,28 and 29, and a pair of front and back needle beds supporting front and back needles 30,31 reciprocable up and down for coaction with the guides 20,21 and the guides 23,24, respectively, and with the guide 22 to produce a double-faced fabric 32, the thread 27 being in the form of a thermoplastic monofilament, preferably two parallel monofilaments, such as of nylon or polypropylene which will later be severed and heated. The other threads 25,26,28 and 29 are preferably multifilament yarns such as of nylon or polyester.

Figure 4:
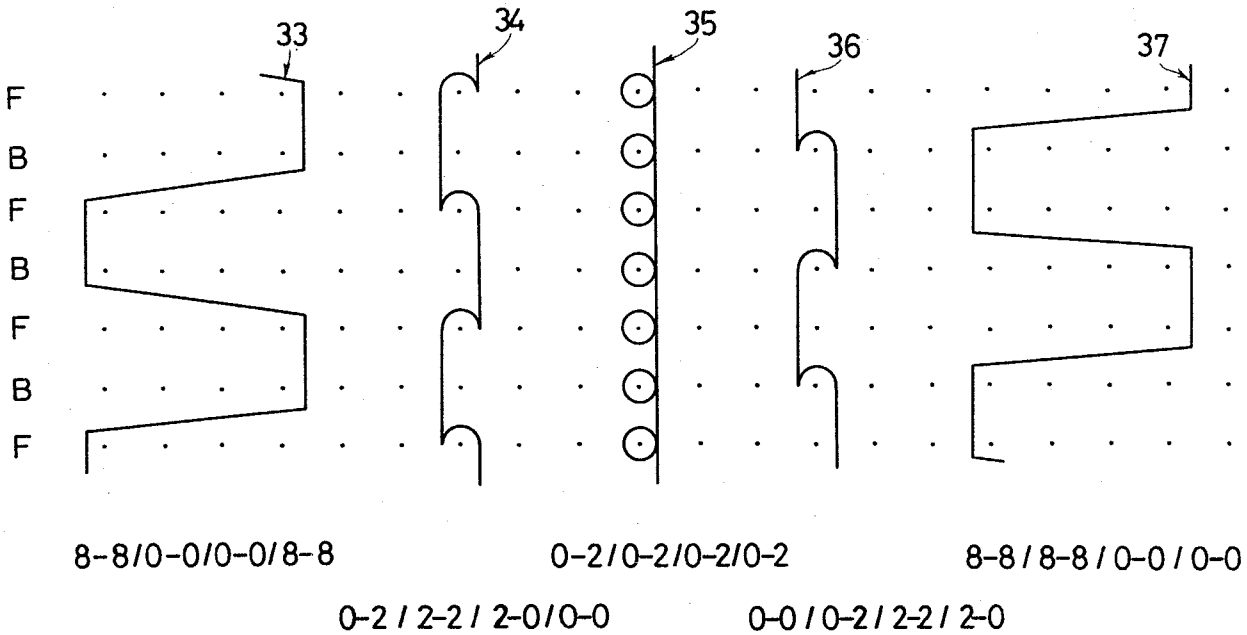
FIG. 4 is a point diagram showing lapping movements of threads.

In FIG. 3, a front ground structure is knitted of the threads 25,26 supplied respectively from the guides 20,21, and a back ground structure is knitted of the threads 28,29 respectively from the guides 23,24, the thread 27 being not illustrated for brevity in FIG. 3. The ground structure has courses formed on the needles (shown as dots) which make up the eight horizontally shown rows, and wales formed on the needles which make up the 20 vertically shown rows. As shown in FIG. 4, the thread 25 is laid-in in a pattern 33 of 8-8/0-0/0-0/8-8, and the thread 26 is knitted as chain stitches 34 in a pattern of 0-2/2-2/2-0/0-0. The thread 27 is knitted as chain stitches 35 in a pattern of 0-2/0-2/0-2/0-2. The thread 28 is knitted as chain stitches 36 in a pattern of 0-0/0-2/2-2/2-0, and the thread 29 is laid-in in a pattern 37 of 8-8/8-8/0-0/0-0. The chain stitches 35 are disposed in both the front and back ground structures to connect them together.

Figure 5:
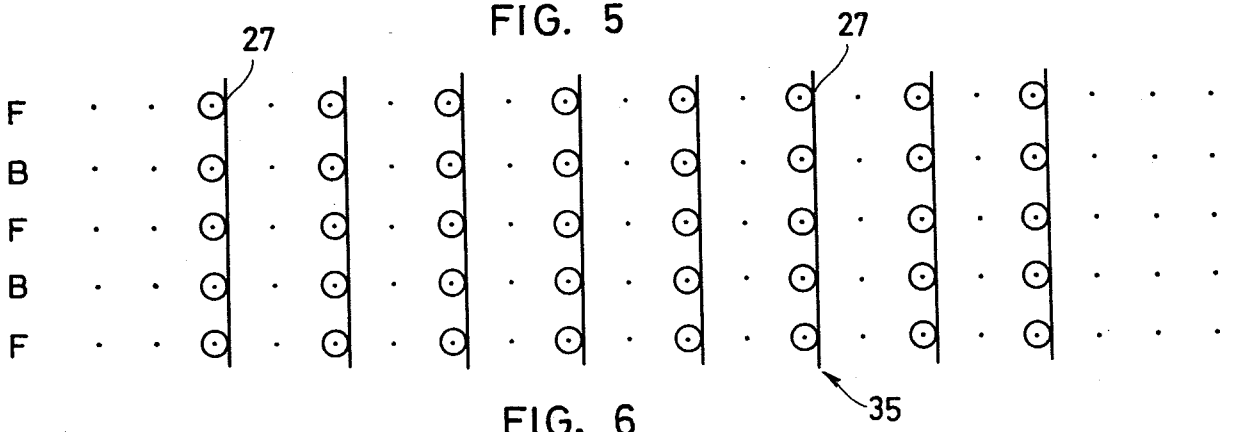
FIGS. 5 through 7 are point diagrams showing various lapping movements of thermoplastic monofilaments.
Figure 6:
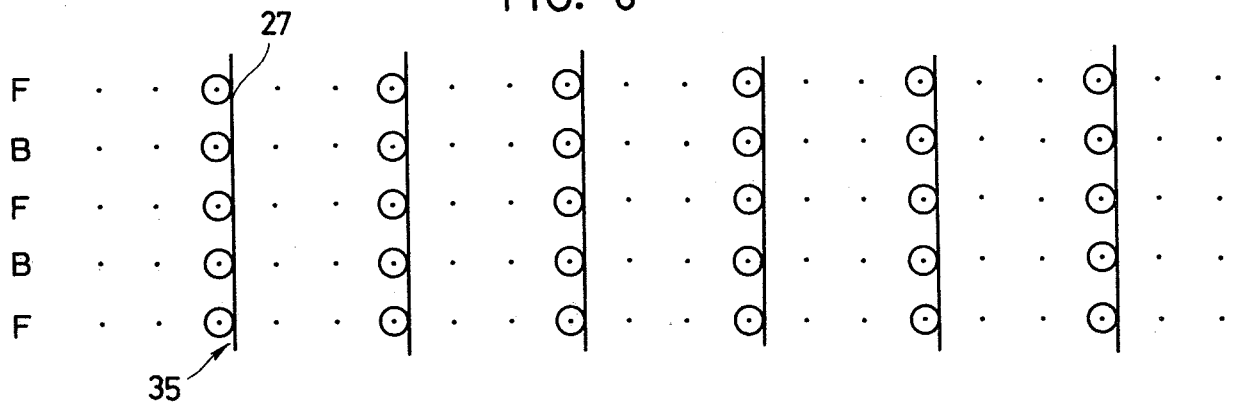
Figure 7:
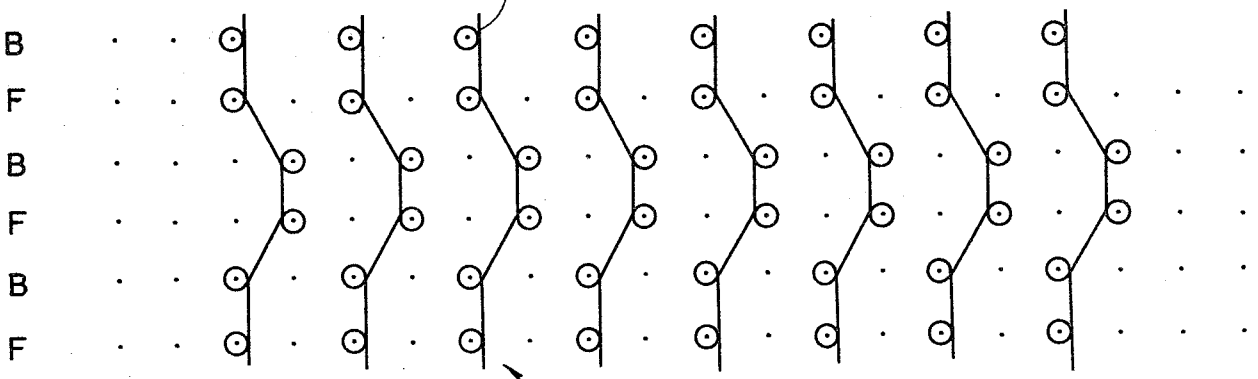

The chain stitches 35 are preferably disposed in alternate wales (FIG. 5) or in every third wale (FIG. 6). Alternatively, the chain stitches 35 may be disposed selectively in adjacent two wales in a pattern of 2-4/2-4/2-0/2-0 as shown in FIG. 7.

Figure 8:
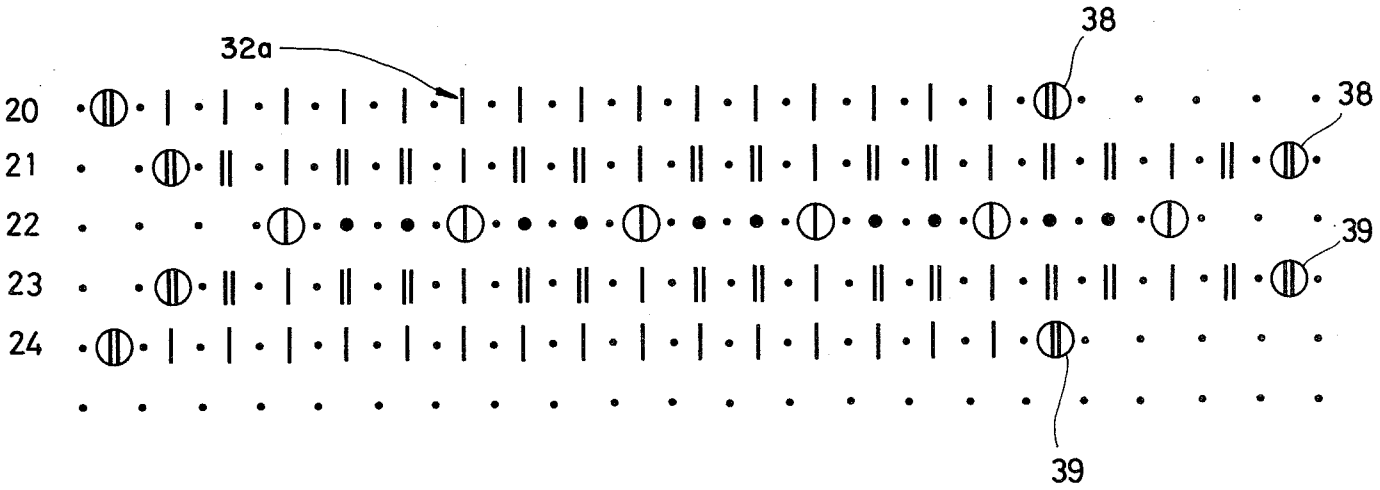
FIG. 8 is a threading diagram for the guides shown in FIG. 1.

As illustrated in FIG. 8, the guides 20, 21, 23 and 24 are fully threaded, and the guides 22 are threaded one-in, one-out to produce the stitch pattern shown in FIG. 5.

Water-soluble threads 38,39 (FIGS. 3 and 8) are laid-in in transversely spaced relation across the double-faced fabric 32 to connect a plurality of fabric strips 32*a* laterally together. The fabric strips 32*a* will finally be separated by dissolving the water-soluble threads 38,39. (Each of FIGS. 3 and 8 illustrate one fabric strip 32*a*.)

Figure 9A:
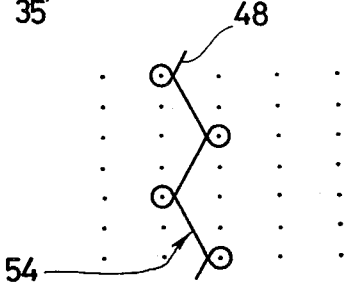
FIGS. 9A and 9B, appearing with FIG. 7, are point diagrams showing lapping movements of threads carried by guides shown in FIG. 2.
Figure 9B:
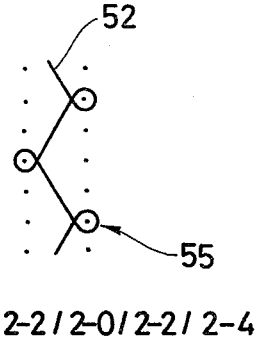

FIG. 2 shows another Raschel warp knitting machine having a total of seven guide bars with guides 40 through 46 supplying threads 47 through 53, respectively, to the front and back needles 30,31 for producing a double-faced fabric 56, which is basically the same as the double-faced fabric 32 of FIG. 1 except for the inclusion of tricot stitches 54,55 (FIGS. 9A and 9B) constituted by the threads 48,52 disposed in the front and back ground structures in patterns of 2-0/2-2/2-4/2-2 and 2-2/2-0/2-2/2-4, respectively, for stiffening the knitted ground structures.

Figure 10:
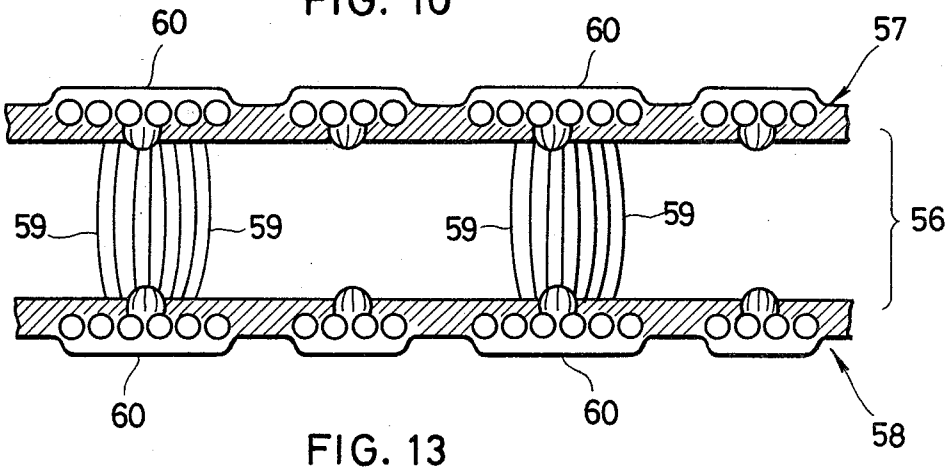
FIG. 10 is an enlarged transverse cross-sectional view of a double-faced fabric.
Figure 13:
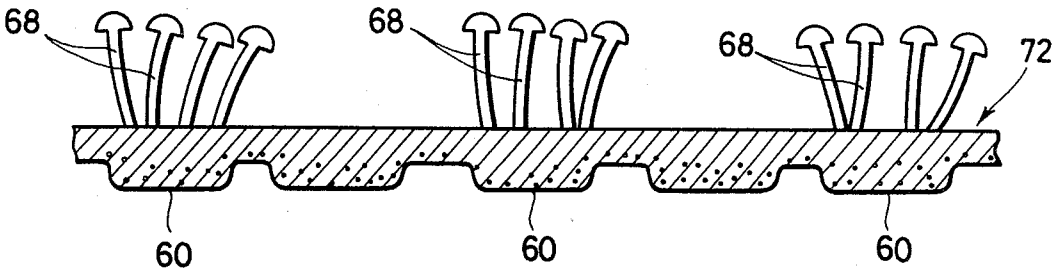
FIG. 13, appearing with FIG. 10, is a transverse cross-sectional view of the fastener web of FIG. 12.

The double-faced fabric 56 comprises a pair of front and back warp-knitted webs 57,58 (FIG. 10) interconnected by spanning thread portions or sinker loops 59 of the chain stitches 35 constituted by the threads 50 and disposed in alternate wales 60. The double-faced fabric 56 thus knitted is then dyed and heatset to fix the stitches permanently in shape. At the same time, the double-faced fabric 56 is dipped into water to dissolve the water-soluble threads 38,39, so that the fabric 56 is separated into a plurality of strips 56*a* (one shown in FIG. 11).

As shown in FIG. 11, each of the strips 56*a* is fed by a pair of first rollers 61,62 to a cutter 63 that severs the thread portions 59 centrally to separate the strip 56*a* into the front and back ground structures 57,58 each having a multiplicity of raised thermoplastic stems 68. The ground structures 57,58 are advanced respectively by a pair of second rollers 64,65 to pass below a pair of heaters 66,67, respectively, for heating the stems 68 to mushroom their ends.

FIGS. 12 through 15 illustrate a velvet-type fastener web 72 including series of interlooped loops 69 disposed in alternate wales 60 and in every course (shown extending horizontally to the wales 60) and knitted with the chain and tricot stitches in the wales 60, each loop having two of the mushroomed stems 68 projecting from the wales 60. The enlarged ends of the stems 68 act as locking heads for coupling engagement with loops on a usual companion velvet-type fastener web (not shown). With the loops 69 being interlooped with each other and knitted in the wales 60, the loops 69 are highly resistant to being loosened out even when the mushroomed stems 68 are pulled by engagement with the loops on the mating fastener web.

Figure 12:
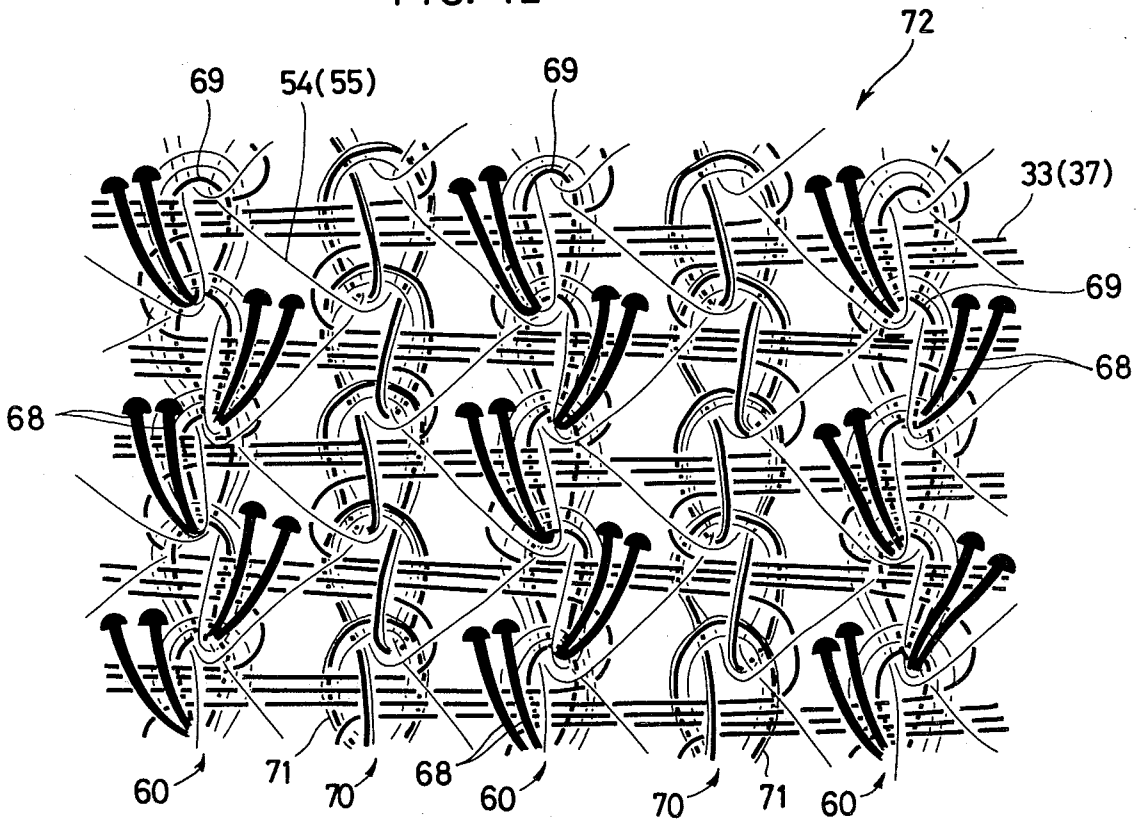
FIG. 12 is an enlarged disgrammatic front view of a velvet-type fastener web.
Figure 14:
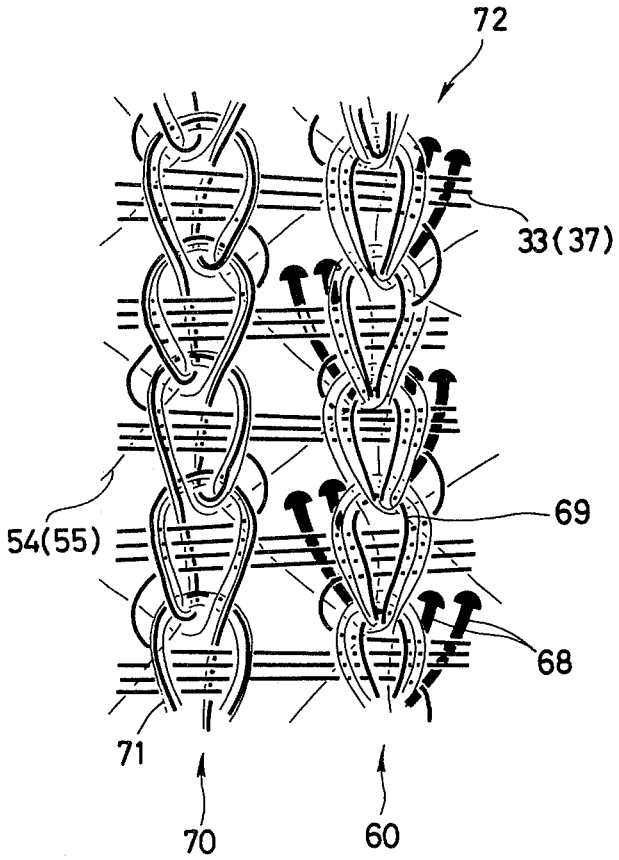
FIG. 14 is an enlarged diagrammatic rear view of the fastener web of FIG. 12.
Figure 15:
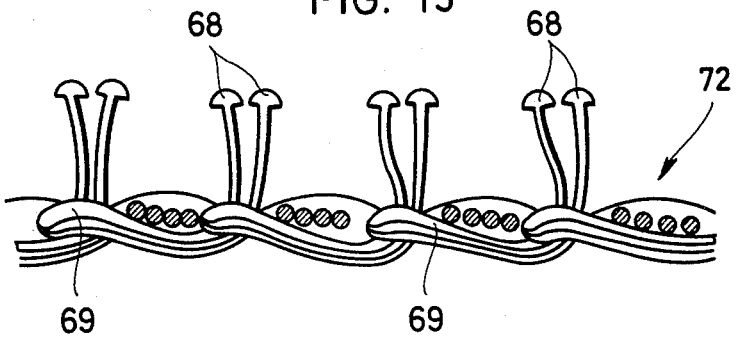
FIG. 15 is a longitudinal cross-sectional view of the fastener web of FIG. 12.

The inclusion of the loops 69 in at least every other wale is preferable because it avoids excessive crowding of the mushroomed stems 68 and permits adequate coupling and separation between interengaging velvet-type fastener webs. As shown in FIGS. 12 and 14, an additional thread 71 may be included as chain stitches in each of wales 70 between adjacent wales 60 for strengthening the wales 70.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A velvet-type fastener web comprising:

(a) a knitted ground structure including a first set of threads having stitches constituting wales and courses, and a second set of threads connecting said wales transversely; and (b) a series of loops of thermoplastic monofilament knitted with said stitches in each of selected wales, each of said loops including a pair of stems projecting from said knitted ground structure at one of said courses and having a pair of locking ends, respectively.

2. A velvet-type fastener web according to claim 1, said series of loops being disposed in alternate wales.

3. A velvet-type fastener web according to claim 1, said series of loops being disposed in every third wale.

4. A velvet-type fastener web according to claim 2 or 3, including a third set of threads knit in wales other than said selected wales.

5. A velvet-type fastener web according to claim 1, said series of loops being prepared by severing chain stitches having the pattern of 0-2/0-2/0-2/0-2.

6. A warp-knitted velvet-type fastener web comprising:

(a) a plurality of first threads having stitches constituting wales and courses;

(b) a plurality of second threads connecting said wales transversely; and (c) a plurality of third threads knit in each of selected wales, and each having a pair of raised locking ends at one of said courses.

7. A warp-knitted velvet-type fastener web according to claim 6, including a plurality of fourth threads knit in wales other than said selected wales.

* * * * *